US007686086B2

(12) United States Patent
Brammer

(10) Patent No.: US 7,686,086 B2
(45) Date of Patent: Mar. 30, 2010

(54) SUBSEA WELL SEPARATION AND REINJECTION SYSTEM

(75) Inventor: Norman Brammer, Turriff (GB)

(73) Assignee: Vetco Gray Inc., Houston, TX (US)

( * ) Notice: Subject to any disclaimer, the term of this patent is extended or adjusted under 35 U.S.C. 154(b) by 733 days.

(21) Appl. No.: 11/297,216

(22) Filed: Dec. 8, 2005

(65) Prior Publication Data

US 2007/0131429 A1 Jun. 14, 2007

(51) Int. Cl.
*E21B 29/12* (2006.01)

(52) U.S. Cl. ..... 166/357; 166/257; 166/267; 166/105.5; 210/170.11

(58) Field of Classification Search ..... 166/357, 166/257, 265, 105.5, 268, 266, 267; 210/170.11, 210/513

See application file for complete search history.

(56) References Cited

U.S. PATENT DOCUMENTS 2,953,204 A * 9/1960 Doscher et al. ..... 166/266
3,718,407 A * 2/1973 Newbrough ..... 417/108
4,134,456 A * 1/1979 Ball ..... 166/356
4,438,817 A * 3/1984 Pokladnik et al. ..... 166/341
4,705,114 A * 11/1987 Schroeder et al. ..... 166/357
4,805,697 A * 2/1989 Fouillout et al. ..... 166/265
4,824,447 A * 4/1989 Goldsberry ..... 96/9
4,848,471 A * 7/1989 Bencze ..... 166/335
5,296,153 A * 3/1994 Peachey ..... 210/787
5,335,732 A * 8/1994 McIntyre ..... 166/313
5,730,871 A * 3/1998 Kennedy et al. ..... 166/265
5,813,469 A * 9/1998 Bowlin ..... 166/369
6,068,053 A * 5/2000 Shaw ..... 166/267
6,082,452 A * 7/2000 Shaw et al. ..... 166/105.5
6,089,317 A * 7/2000 Shaw ..... 166/265
6,092,599 A * 7/2000 Berry et al. ..... 166/265
6,092,600 A * 7/2000 McKinzie et al. ..... 166/266
6,131,655 A * 10/2000 Shaw ..... 166/105.5
6,138,758 A * 10/2000 Shaw et al. ..... 166/265
6,189,614 B1 * 2/2001 Brady et al. ..... 166/266
6,196,310 B1 * 3/2001 Knight ..... 166/105.5
6,197,095 B1 * 3/2001 Ditria et al. ..... 95/248
6,209,641 B1 * 4/2001 Stevenson ..... 166/266
6,336,504 B1 * 1/2002 Alhanati et al. ..... 166/265
6,457,522 B1 * 10/2002 Bangash et al. ..... 166/267
6,637,514 B1 10/2003 Donald et al.
6,640,901 B1 * 11/2003 Appleford et al. ..... 166/357
6,651,745 B1 11/2003 Lush et al.
6,968,902 B2 * 11/2005 Fenton et al. ..... 166/358

(Continued)

FOREIGN PATENT DOCUMENTS

GB 2236779 A 4/1991

(Continued)

*Primary Examiner*—Thomas A Beach
(74) *Attorney, Agent, or Firm*—Bracewell & Giuliani

(57) ABSTRACT

A subsea well assembly has a string of casing with perforations leading to a producing zone and perforations leading to an injection zone. A string of production tubing extends into the casing in communication with the producing formation. A barrier separates the interior of the tubing from the injection zone formation. A subsea Christmas tree is located at the upper end of the well. A subsea separator is connected to a production outlet of the tree for separating waste fluid from the well fluid. A subsea injection pump pumps waste fluid from the separator back to the tree and into the injection formation.

13 Claims, 3 Drawing Sheets

U.S. PATENT DOCUMENTS

| | | | | |
|---|---|---|---|---|
| 7,013,978 | B2 * | 3/2006 | Appleford et al. | 166/357 |
| 7,093,661 | B2 * | 8/2006 | Olsen | 166/357 |
| 7,111,687 | B2 * | 9/2006 | Donald et al. | 166/368 |
| 7,134,498 | B2 * | 11/2006 | Hopper | 166/357 |
| 7,152,681 | B2 * | 12/2006 | Olsen et al. | 166/357 |
| 7,152,682 | B2 * | 12/2006 | Hopper | 166/357 |
| 7,175,748 | B2 * | 2/2007 | Michaelsen et al. | 204/547 |
| 7,363,982 | B2 * | 4/2008 | Hopper | 166/357 |
| 7,520,989 | B2 * | 4/2009 | Ostergaard | 210/512.1 |
| 2003/0150731 | A1 | 8/2003 | Michaelsen et al. | |
| 2004/0069494 | A1 * | 4/2004 | Olsen et al. | 166/357 |
| 2004/0099422 | A1 | 5/2004 | Lush et al. | |
| 2004/0200620 | A1 * | 10/2004 | Ostergaard | 166/357 |
| 2004/0200621 | A1 * | 10/2004 | Ostergaard | 166/357 |
| 2004/0244983 | A1 * | 12/2004 | Appleford et al. | 166/357 |
| 2004/0245182 | A1 * | 12/2004 | Appleford et al. | 210/739 |
| 2004/0251030 | A1 | 12/2004 | Appleford et al. | |
| 2005/0061514 | A1 * | 3/2005 | Hopper | 166/357 |
| 2005/0109514 | A1 | 5/2005 | White et al. | |
| 2005/0173322 | A1 * | 8/2005 | Ostergaard | 210/170 |
| 2006/0124313 | A1 * | 6/2006 | Gramme et al. | 166/357 |
| 2007/0138085 | A1 * | 6/2007 | Biester | 210/512.1 |

FOREIGN PATENT DOCUMENTS

| | | | |
|---|---|---|---|
| GB | 2347183 | A | 8/2000 |
| GB | 2402687 | A | 12/2004 |
| WO | WO99/35370 | | 7/1999 |
| WO | WO2005/047646 | A1 | 5/2005 |
| WO | WO2005/083228 | A1 | 9/2005 |

* cited by examiner

SUBSEA WELL SEPARATION AND REINJECTION SYSTEM

FIELD OF THE INVENTION

This invention relates in general to subsea well oil and gas production, and in particular to a system having a subsea separator and injection pump for injecting separated waste fluid back into the well.

BACKGROUND OF THE INVENTION

One type of subsea well production utilizes a subsea Christmas tree located at the sea floor at the upper end of the well. The Christmas tree has valves and a choke for controlling the well fluid being produced.

In one type of production, the fluid flows from the tree to a production platform at the surface. The production platform has separators for separating waste products, such as water, from the well fluid. One method to dispose of the separated water is to pump it back down conduits to subsea injection wells. This system requires sufficiently high pressure in the well in order to convey the well fluid, which still contains water, to the production platform. In very deep water, the well pressure may be inadequate. Also, the injection pump must have sufficient capacity to overcome the frictional effects of the conduits leading to the injection wells, which may be remote from the wells being produced.

Installing a subsea separator adjacent a subsea well for separating fluid has been proposed. Also, subsea pumps have been proposed for location on or adjacent wellhead assemblies for boosting the pressure at the wellhead to convey fluids to a floating production vessel.

SUMMARY OF THE INVENTION

In this invention, a subsea Christmas tree is located at the upper end of a subsea well for controlling well fluid flowing up the well. A subsea separator is located at the outlet of the tree for separating waste fluid, such as water, from the well fluid. A subsea injection pump is connected to the waste fluid outlet of the separator for pumping waste fluid back into the well into an injection formation.

In two embodiments, the separator and injection pump are carried on a frame that is supported by the tree. In one of these embodiments, the pump and separator are located above the tree and in the other of these embodiments, the separator and pump are supported by the tree on a lateral side of the tree. In a third embodiment, the separator and pump are mounted alongside the tree and supported independently.

The injected fluid may be injected to a tubing annulus surrounding the production tubing. Alternately, a separate string of tubing for injection could be utilized.

DETAILED DESCRIPTION OF THE INVENTION

Figure 1:
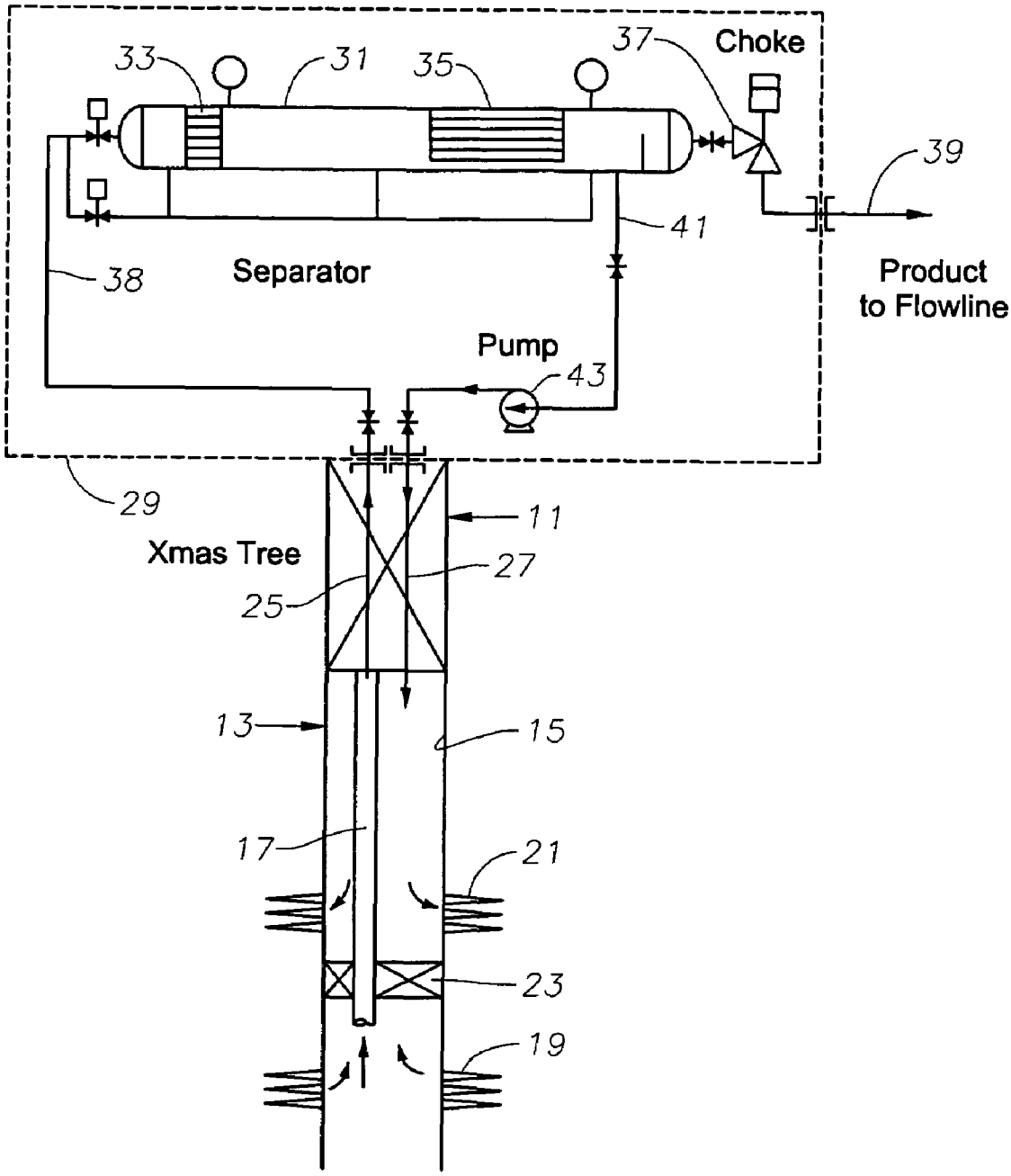
FIG. 1 is a schematic of a subsea well production system constructed in accordance with this invention.

Referring to the embodiment of FIG. 1, a Christmas tree 11 is mounted to the upper end of a well 13. Well 13 typically has at least two strings of casing 15, but in the schematic, the multiple strings of casing are illustrated schematically as a single string, which is the production string. A string of production tubing 17 is suspended in casing 15. Casing 15 is cemented in well 13 and has a set of production formation apertures or perforations 19. Perforations 19 communicate the interior of casing 15 with well fluid of a producing formation. Also, casing 15 has a set of injection apertures or perforations. Injection perforations 21 communicate the interior of casing 15 with an injection zone or formation. In this embodiment, injection perforations 21 are located above production perforations 19, but that could be reversed in other wells. A packer 23 separates perforations 19 from perforations 21, packer 23 being sealed between casing 15 and tubing 17.

Tree 11 has a production passage 25 that is in fluid communication with production tubing 17. Tree 11 also has a tubing annulus passage 27 that is fluid communication with the annulus surrounding production tubing 17. Tree 11 could be of a type wherein the tubing hanger (not shown) for tubing 17 lands in the wellhead housing below the tree and has two bores, one for production passage 25 and one for tubing annulus 27. Alternately, production tree 11 could be of the "horizontal" or "spool" type, wherein the tubing hanger for production tubing 17 lands in the tree and has only a single bore for production passage 25. The tubing annulus passage 27 in that instance extends through a portion of tree 11 and bypasses the tubing hanger.

A support frame 29 is mounted to and above tree 11. In this embodiment, support frame 29 preferably mounts to an upward protruding mandrel (not shown) of tree 11. The mandrel comprises a cylindrical member having an exterior grooved profile for receiving a connector (not shown) of support frame 29. A subsea separator 31 is mounted on support frame 29 above tree 11 and has its inlet connected to tree 11 by a conduit 38. Separator 31 could be of a variety of types. In this embodiment, it is schematically shown to be a type having a coalescent unit 33 and a dielectrophoresis unit 35, such as described in US published application 2003/0150731. Separator 31 is horizontally mounted and has a choke 37 located at its product outlet end, which is connected to a product flow line 39 leading to a remote processing and transport facility. Placing choke 37 at the outlet end of separator 31 results in the interior of separator 31 being substantially at wellhead pressure. Alternately, choke 37 could be located on tree 11, upstream from separator 31. Choke 37 is a conventional variable orifice device that varies the flow rate and thus the back pressure in tree production passage 25.

Fluid separated by separator 31 is typically water but it alternately could be or contain gas. This fluid, called herein for convenience "waste fluid", proceeds through a waste fluid outlet 41 to the inlet of an injection pump 43. Injection pump 43 is a subsea pump and could be of a variety of types. If the waste fluid happens to be gas, injection pump 43 may comprise a compressor, and the term "pump" is meant to include compressors. Preferably, injection pump 43 is driven by an electrical motor. Injection pump 43 has an outlet to tubing annulus passage 27 for discharging waste fluid into casing 15.

In the operation of the first embodiment, well fluid from production formation perforations 19 flows up production tubing 17 and production passage 25 in tree 11 to inlet line 38 of separator 31. Separator 31 separates waste fluid from the well fluid and passes the product fluid through choke 37 to product flow line 39. The product flows through flow line 39 to a processing and transport facility, typically a floating platform. Separator 31 passes the waste fluid through waste outlet 41 to injection pump 43. Injection pump 43 injects the waste fluid into tubing annulus passage 27. The waste fluid flows down casing 15 in the annulus surrounding tubing 17 and into an injection zone through injection perforations 21.

Figure 3:
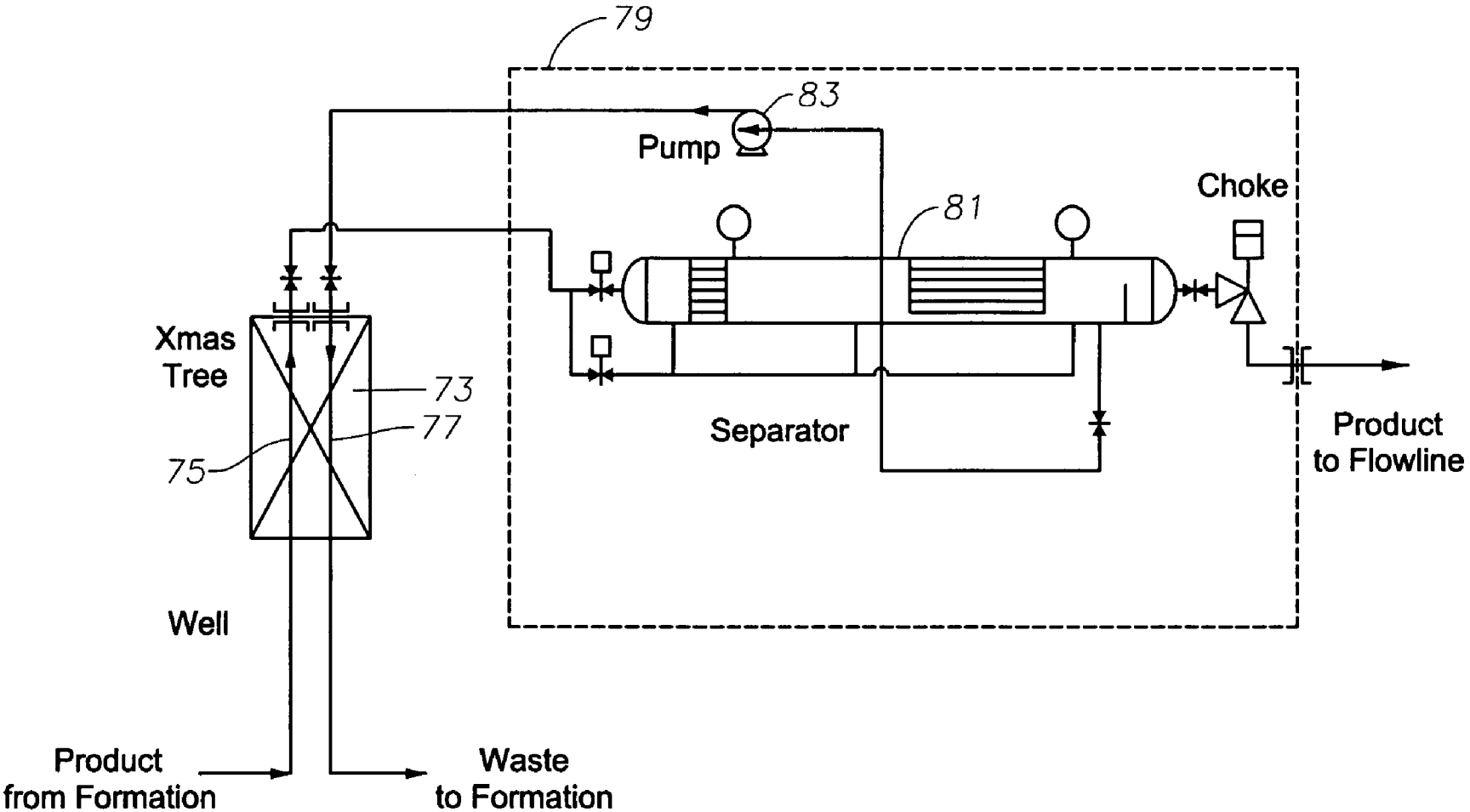
FIG. 3 is a schematic of another alternate embodiment of a subsea well production system in accordance with this invention.

In the embodiment of FIG. 3, tree 45 may be either a conventional type or a horizontal type. Tree 45 is located at the upper end of a well 47 having a string of production casing 49. Production tubing 51 is suspended in casing 49 for receiving flow from production formation perforations 53. An upper packer 55 may be used to separate production formation perforations 53 from the annulus of production tubing 51.

Tree 45 has a production passage 57 and an injection passage 59. In this example, injection passage 59 is in fluid communication with a string of injection tubing 61 suspended in casing 49 alongside production tubing 51. Injection passage 59 may extend through the tubing hanger alongside production passage 57, or it may be routed in another manner. Production tubing 51 is in fluid communication with injection formation perforations 63. A lower packer 65 separates injection formation perforations 63 from production formation perforations 53. Lower packer 65 seals between injection tubing 61 and casing 15. Upper packer 55 has a sealing passage through which injection tubing 61 passes. Although injection formation perforations 63 are shown lower than production formation perforations 53, this could be opposite in other wells.

Figure 2:
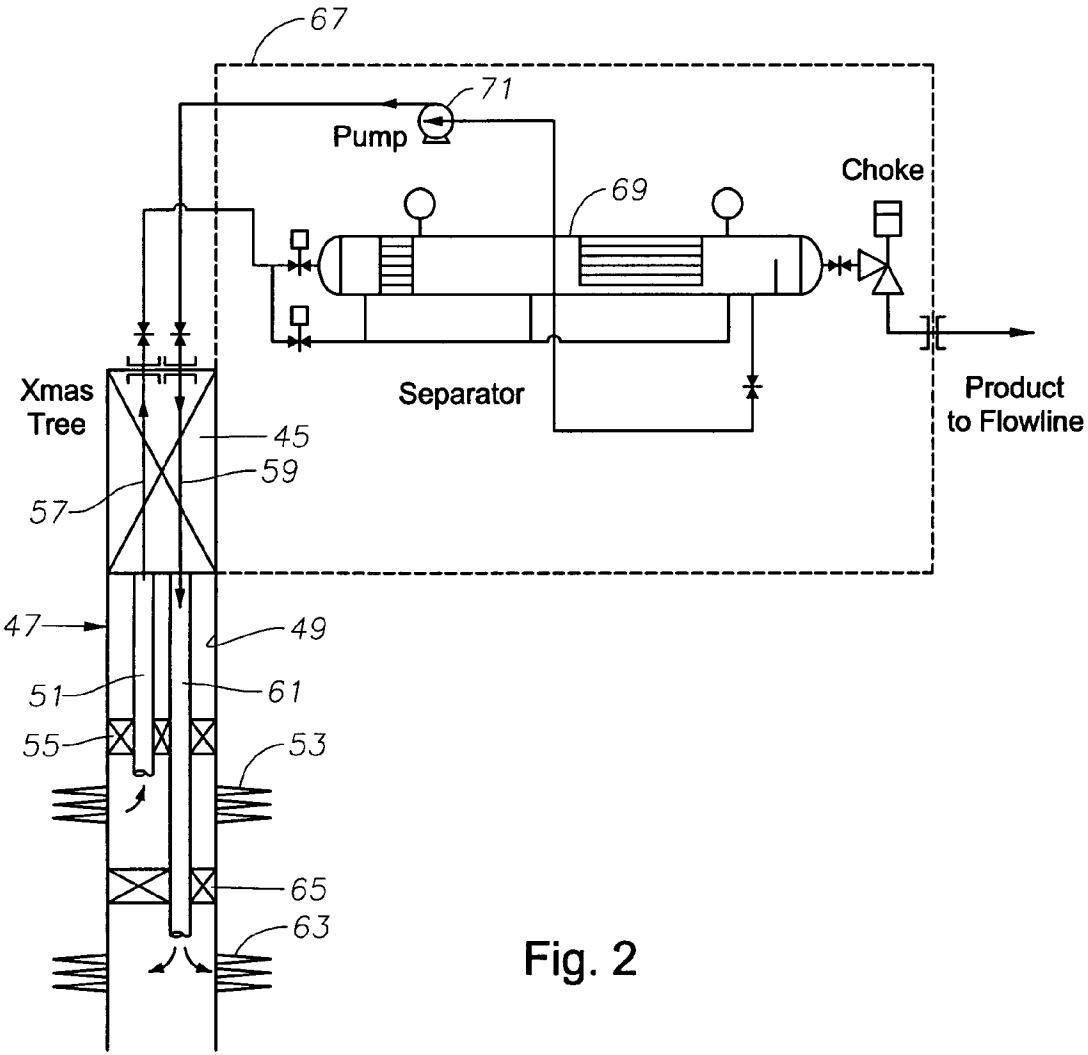
FIG. 2 is a schematic of an alternate embodiment of a subsea well production system in accordance with this invention.

Another optional difference between the embodiment of FIG. 2 and that of FIG. 1 is the support frame 67. Support frame 67 is mounted to tree 45 for support by tree 45 above the sea floor. It may be mounted to the mandrel with a mandrel connector (not shown) as in the first embodiment. However, in this embodiment, rather than being located above, support frame 67 is cantilevered out laterally from tree 45.

A separator 69 that may be the same as separator 31 in the first embodiment is mounted to support frame 67 with its inlet in fluid communication with production passage 57. An injection pump 71 is connected between injection passage 59 and the waste fluid outlet of separator 69. In the embodiment of FIG. 2, the operation is the same as described above except injection pump 71 injects fluid into injection tubing 61 rather than into the casing, such as casing 15 in the first embodiment.

In the third embodiment, shown in FIG. 3, Christmas tree 73 may be mounted to a well constructed as in FIG. 1 or as in FIG. 2 or other types. Tree 73 has a production passage 75 and an injection passage 77. As in the other embodiments, tree 73 may be either a conventional type having two vertical tree bores 75, 77 or it may be a spool or horizontal type.

The difference between this embodiment and the others principally is that the support frame 79 is not supported by tree 73. Rather, it is mounted alongside and independently supported above the sea floor. Support frame 79 supports a separator 81 and an injection pump 83. Separator 81 and injection pump 83 may be the same as in the first two embodiments.

The invention has significant advantages. Locating separator and an injection pump at a subsea tree allows the operator to inject fluid back into the same well that the operator is producing from. The disposal of waste water may assist in the production of well fluids and provides an efficient means of disposal. This system avoids costs associated with transporting waste fluid to and away from a floating production vessel to a remote injection well. This system may also avoid the need for having a booster pump to pump well fluids to a remote production vessel.

While the invention has been shown in only three of its forms, it should be apparent to those skilled in the art that it is not so limited but susceptible to various changes without departing from the scope of the invention.

I claim:

1. A subsea well assembly, comprising:

a subsea Christmas tree for location at an upper end of a subsea well for controlling well fluid containing water and oil flowing up the well;

a subsea water/oil separator at an outlet of the tree for separating water from the well fluid, the separator comprising a cylindrical, elongated housing having a longitudinal axis and containing a device for separating water from oil in the well fluid;

a subsea injection pump at a water outlet of the separator, the injection pump being connected to the tree for injecting water back into the well; and wherein the separator and the injection pump are mounted to a mandrel of the tree such that their weights are supported by the tree and the longitudinal axis of the housing of the separator is transverse to a longitudinal axis of the tree.

2. The assembly according to claim 1, wherein the separator and the injection pump are and located above the tree.

3. The assembly according to claim 1, wherein the separator and the injection pump are directly mounted to and cantilever supported only by the tree on a lateral side of the tree offset from the longitudinal axis of the tree.

4. A subsea well assembly, comprising:

a string of casing cemented in the well, the casing having a first set of apertures in fluid communication with a production formation and a second set of apertures in fluid communication with an injection formation;

a string of production tubing extending into the casing, the tubing having an interior in fluid communication with the production formation;

a barrier separating the interior of the tubing from fluid communication with the injection formation;

a subsea Christmas tree located at an upper end of the well and in fluid communication with the interior of the tubing for controlling well fluid flowing from the production formation up the tubing;

a subsea water/oil separator connected to a production outlet of the tree for separating water from the well fluid, the separator comprising an elongated cylindrical housing having a longitudinal axis and a separator device for separating water from oil in the well fluid;

a subsea injection pump having an intake at a water outlet of the separator, the injection pump having an outlet connected to the tree for injecting water into the injection formation; and wherein the separator and the pump are mounted to a mandrel of the tree such that their weights are supported by the tree, and the longitudinal axis of the housing of the separator being perpendicular to a longitudinal axis of the tree.

5. The assembly according to claim 4, further comprising a supporting frame mounted on an upper end of and supported by the tree, the separator and the pump being mounted on the supporting frame above the tree.

6. The assembly according to claim 4, further comprising a supporting frame mounted directly to and supported only by the tree, the supporting frame extending laterally from the tree, the separator and the pump being mounted on the supporting frame alongside and offset from a longitudinal axis of the tree.

7. The assembly according to claim 4, wherein the injection pump injects the water into a tubing annulus surrounding the tubing.

8. The assembly according to claim 4, further comprising:

a string of injection tubing extending through the casing alongside the production tubing and having an upper inlet in fluid communication with the injection pump and a lower outlet in fluid communication with the injection formation.

9. A method of producing a subsea well, comprising:

(a) installing a subsea Christmas tree at an upper end of a subsea well, mounting a subsea water/oil separator and subsea injection pump to a mandrel of the tree such that their weights are supported by the tree, the separator having an elongated cylindrical housing with a longitudinal axis oriented horizontally and containing a separating device connecting the separator to an outlet of the tree, and connecting the pump to a water outlet of the separator and to the tree;

(b) flowing well fluid up the well through the tree and into the housing of the separator;

(c) separating water from the well fluid within the housing of the separator; and (d) with the injection pump, injecting the water separated by the separator back through the tree into an injection formation in the well.

10. The method according to claim 9, wherein step (a) comprises mounting the separator and the injection pump on and above the tree.

11. The method according to claim 9, wherein step (a) comprises cantilever mounting the separator and the injection pump directly to the tree for support only by the tree above a sea floor on a lateral side of and offset from a longitudinal axis of the tree.

12. The method according to claim 9, wherein:

step (b) comprises flowing the well fluid up a string of production tubing installed in the well; and step (d) comprises injecting the water into a tubing annulus surrounding the production tubing.

13. The method according to claim 9, wherein:

step (a) comprises installing a string of production tubing in the well in communication with a production formation, and installing a string of injection tubing in the well in communication with an injection formation;

step (b) comprises flowing the well fluid up the string of production tubing; and step (d) comprises injecting the water into the injection tubing.

* * * * *